United States Patent [19]

Kanazawa et al.

[11] Patent Number: 4,765,284

[45] Date of Patent: Aug. 23, 1988

[54] COOLING CONTROL APPARATUS OF AUTOMOBILE ENGINE

[75] Inventors: Yoshifusa Kanazawa; Masayuki Kumada, both of Saitamo, Japan

[73] Assignee: Honda Giken Kogyo Kabushiki Kaisha, Tokyo, Japan

[21] Appl. No.: 820,420

[22] Filed: Jan. 17, 1986

[30] Foreign Application Priority Data

Jan. 19, 1985 [JP] Japan ..... 60-6672

[51] Int. Cl.[4] ..... F01P 5/02

[52] U.S. Cl. ..... 123/41.49; 123/41.12

[58] Field of Search ..... 123/41.11, 41.12, 41.49, 123/41.65, 41.66

[56] References Cited

U.S. PATENT DOCUMENTS

| | | | |
|---|---|---|---|
| 2,729,203 | 1/1956 | Prendergast | 123/41.12 |
| 4,378,760 | 4/1983 | Barge | 123/41.49 |
| 4,426,960 | 1/1984 | Hart | 123/41.49 |
| 4,590,892 | 5/1986 | Nose et al. | 123/41.12 |
| 4,651,922 | 3/1987 | Noba | 123/41.12 X |

FOREIGN PATENT DOCUMENTS

| | | | |
|---|---|---|---|
| 2237979 | 2/1974 | Fed. Rep. of Germany . | |
| 2806708 | 8/1978 | Fed. Rep. of Germany | 123/41.12 |
| 203816 | 12/1982 | Japan | 123/41.49 |
| 211524 | 9/1983 | Japan . | |
| 2026610 | 2/1980 | United Kingdom | 123/41.12 |
| 1601968 | 11/1981 | United Kingdom . | |

*Primary Examiner*—Tony M. Argenbright
*Assistant Examiner*—Eric R. Carlberg
*Attorney, Agent, or Firm*—Lyon & Lyon

[57] ABSTRACT

A cooling control apparatus for an automobile engine having a radiator and two or more electrically operated fans for circulating air through the radiator. Each fan is operated in response to a different predetermined temperature of the cooling water in the radiator so that first one fan is activated under normal operation and the second fan is operated only under heavier loads or high ambient conditions requiring additional cooling. In one embodiment a fan is operated upon activation of the air-conditioning system to cool its condenser regardless of the cooling water temperature.

16 Claims, 3 Drawing Sheets

FIG. 1.
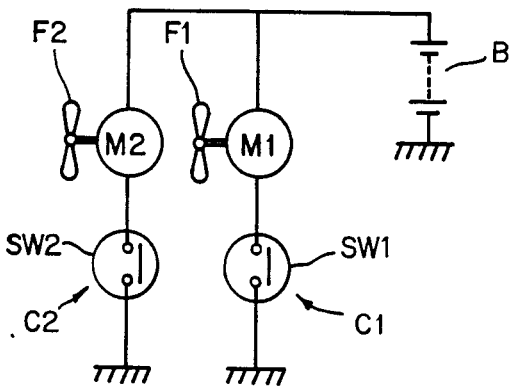
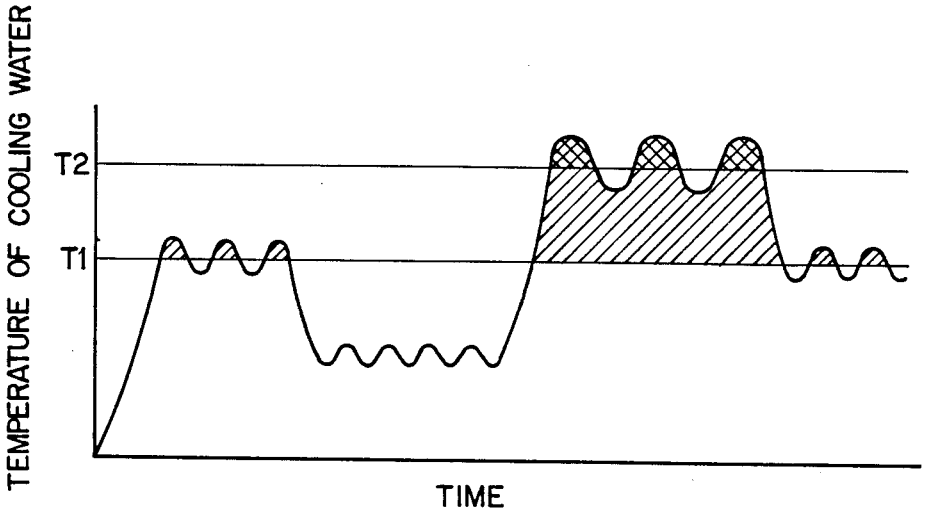
FIG. 2.

COOLING CONTROL APPARATUS OF AUTOMOBILE ENGINE

This invention relates to a control apparatus for the cooling system of an engine equipped with a cooling fan driven by an electrical fan motor and, more particularly, to a control apparatus for the cooling system of an automobile engine equipped with a plurality of such cooling fans.

Electrical motors with fans are being used for the radiators of automobile cooling systems with increasing frequency since they provide sufficient cooling power even when the car is idling. Such a motorized cooling fan is generally energized by a constant-voltage source such as a battery. The fan motor is controlled by a control circuit including a thermostatic switch or the like so that it is rotated when the engine temperature rises above a given value and stopped when the engine temperature drops below the given value. However, a fan motor energized by the constant voltage source has a fixed rotation frequency during operation so that the air flow volume produced by the cooling fan is substantially constant. Accordingly, a high capacity cooling fan must be selected for supplying the cooling power required when the car is driven under the heaviest conditions, for example, when the car is idling in parking after high-speed operation or is going up a slope at a low speed in very warm ambient conditions. If the capacity of the cooling fan is too small, the engine will be subject to overheating under such heavy driving conditions.

On the other hand, during times of ordinary driving, the load of the engine is comparatively small and a head wind is supplied to the radiator whereby a large cooling power is not required of the cooling fan. As a result, the cooling fan tends to be rotated unnecessarily at a high speed, so that the consumption power when the fan is in operation is very large and the external noise is loud. One possible solution to such a problem is to establish a high temperature for required operation of the fan motor, but this results in a decrease in the efficiency of the engine.

Another problem of cooling occurs with automobile air condition system. Recently, some automobiles equipped with an air conditioner have been designed so that the condenser is mounted in front of the radiator and two fans are included to cool the radiator and condenser. In such a car the fan for the condenser is driven only during the time the air conditioner is operated.

The present invention has been devised in view of the foregoing circumstances and its object is to supply cooling air varying in volume depending upon the engine temperature thereby to reduce the power consumption and noise caused by the cooling fan at the times that the engine is under a low load or cool ambient condition.

It is another object of the present invention to utilize more effectively a plurality of cooling fans provided with the automobile.

A more detailed object of the present invention is to provide a plurality fan motors selectively operated for driving a plurality of cooling fans equipped in the automobile when the engine temperature reaches respective predetermined different values.

By the arrangement of the present invention, as the engine temperature rises, a first fan motor which is set to operate at the lowest required temperature for cooling starts to rotate at first, and the engine is cooled only by that first cooling fan motor. Then, if the cooling power provided only by the first cooling fan is inadequate, the engine temperature continues to rise and a second fan motor starts to rotate whereby the engine is cooled by two cooling fans. In this manner, the supply volume of cooling air is changed in response to the engine temperature and there is provided the cooling effect adapted to various conditions. Therefore, because only one cooling fan of a comparatively small capacity is actuated during the time the engine is under a low load, the power consumption and noise at that time is reduced.

Other objects and advantages of the present invention will appear from the preferred embodiments which will now be described in connection with the accompanying drawings, wherein:

FIG. 1 is a diagrammatic illustration of the circuit of a first embodiment of the present invention;

FIG. 2 is a graph of the temperature of the cooling water for the engine as such temperature varies over a period of time while the engine is subject to different operating conditions;

Figure 3:
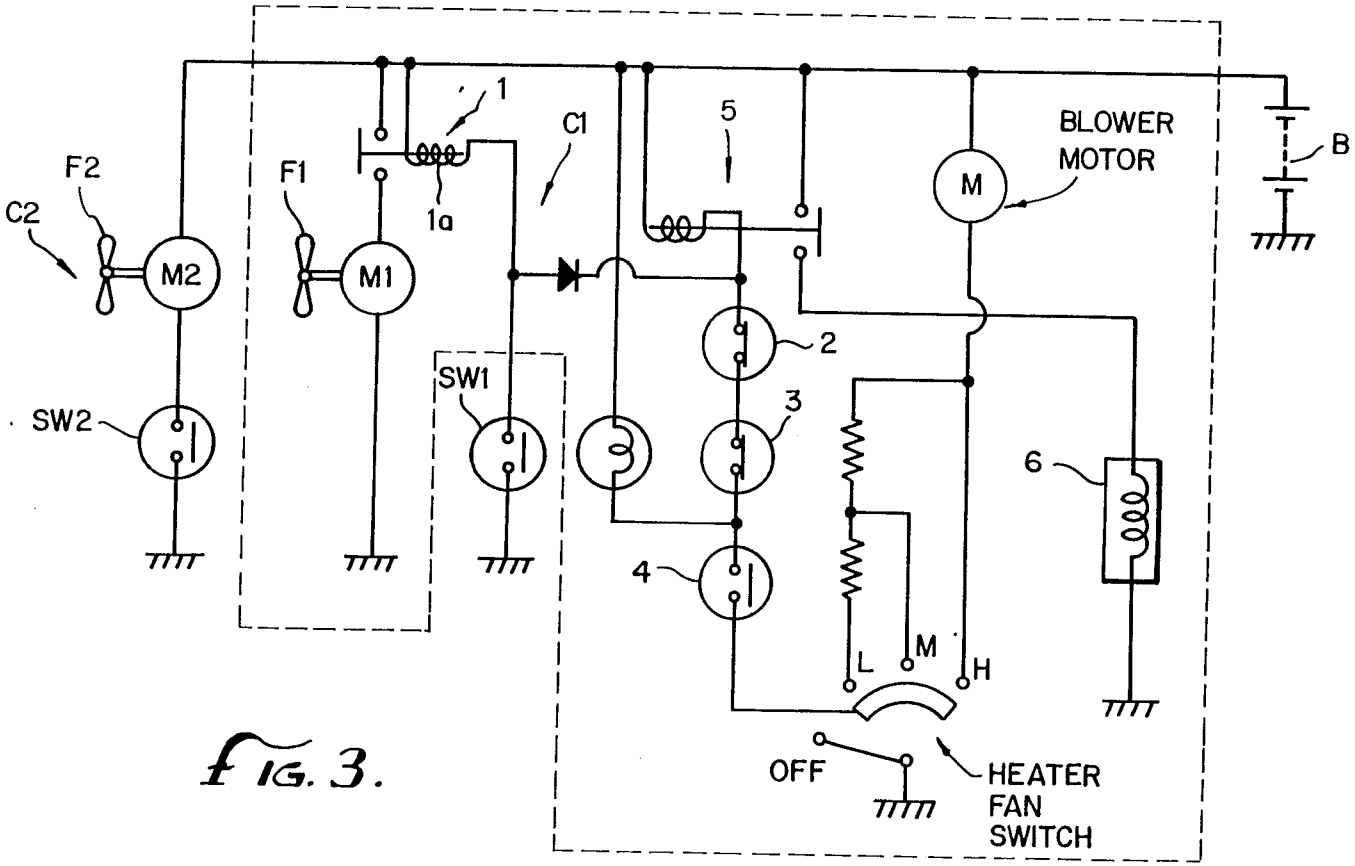
FIG. 3 is a diagrammatic illustration of the circuit of a second embodiment of this invention as applied to an automobile equipped with an air conditioner.

Referring more particularly to FIG. 1, a conventional water coolant radiator (not shown) of the automobile engine is supplied with cooling air by two cooling fans F1 and F2, and each cooling fan F1, F2 is driven by a corresponding fan motor M1, M2. These fan motors M1 and M2 are connected in parallel between a battery B and the automobile chassis for an electrical ground. In each electric path of the fan motor M1, M2 there is provided a control circuit C1, C2 including an individual water temperature switch SW1, SW2.

Each water temperature switch SW1, SW2 is a thermostatic switch which detects the temperature of the engine cooling water, and operates in such a manner that the switch turns on when the cooling water temperature rises above a predetermined temperature and turns off when the cooling water temperature drops below that predetermined temperature. Preferably, each switch SW1, SW2 is mounted in the vicinity of an outlet from the radiator, whereby it is responsive to the temperature of the cooling water that has been cooled by the radiator and before the cooling water enters the engine. The predetermined temperature T1 of the first water temperature switch SW1 is preferably set to a comparatively low value, for example, about 90° C., which is approximately a minimum desired operating temperature for the engine. The predetermined temperature T2 of the second water temperature switch SW2 is preferably set to about 100° C., or a predetermined value larger than the former.

In the cooling control device of the foregoing configuration for the automobile engine, as the engine is started, the cooling water temperature rises gradually with an increase of the engine temperature, as shown in the graph of FIG. 2 starting at the left end of the time line. However, the cooling water temperature does not reach the set temperature T1 of the first water temperature switch SW1 during the warming-up period and therefore the first and second water temperature switches SW1 and SW2 are left open and the electric paths for the fan motors M1 and M2 are kept in the broken or non-operating state. Accordingly, neither of the cooling fans F1, F2 operates and the warming-up period is completed within a short time.

As the warming-up period terminates and the temperature of the engine cooling water reaches the set temperature T1 of the first water temperature switch SW1, the first water temperature switch SW1 closes and the power supply to the first fan motor M1 is commenced. As a result, the first cooling fan F1 starts to rotate and cooling of the engine cooling water begins. When the cooling water temperature drops below the set temperature T1 of the first water temperature switch SW1 as the result of cooling of the engine and radiator, the first water temperature switch SW1 opens again and the first cooling fan F1 stops. In this example the temperature of the engine cooling water has values at and about the set temperature T1 of the first water temperature switch SW1, the engine is cooled by the first cooling fan F1 only. FIG. 2 shows three On-Off cycles of fan F1, with slant hatching for the On condition, following the warming-up.

As the automobile enters an ordinary constant-speed running state, the load on the engine becomes small and the engine is cooled by the normal head wind caused by running, so that the temperature of the engine cooling water becomes lower than the set temperature T1 of the first water temperature switch SW1 and the first cooling fan F1 is kept in the stopped state, as shown next in the graph of FIG. 2.

When the automobile is changed from a high-speed running state to an idling state or is driven at a low running speed in warm ambient conditions, the temperature of the engine cooling water first reaches the set temperature T1 of the first water temperature switch SW1 and the first cooling fan F1 starts to rotate. Then, because the cooling power of only the first cooling fan F1 is not sufficient for the engine, the cooling water temperature rises further and reaches the set temperature T2 of the second water temperature switch SW1. As a result, the second water temperature switch SW2 is closed also, so that the second fan motor M2 is energized and the second cooling fan F2 starts to rotate. In this manner, the engine is cooled sufficiently by the large quantity of cooling air supplied by the two cooling fans F1 and F2. As the engine is cooled and the cooling water temperature drops below the set temperature T2 of the second water temperature switch SW2, the second water temperature switch SW2 opens and the second cooling fan F2 stops, whereby the engine and radiator are cooled only by the first cooling fan F1 again. If the cooling power of one cooling fan F1 is not enough for the engine, the cooling water temperature rises again and both cooling fans F1 and F2 will be driven. Again this is shown by FIG. 2, with the On operation of fan F2 shown by double cross hatching, as three cycles of operation. Through the foregoing repetitive operation the engine is cooled appropriately.

By the foregoing processes, the engine is cooled by one cooling fan F1 when the cooling water temperature has reached a comparatively low value given, or by two cooling fans F1 and F2 when the engine has reached a given value higher than the former, whereby a desirable degree of cooling performance corresponding to the current temperature of the engine is provided. Accordingly, each of the cooling fans F1 and F2 need only have a small capacity for providing a comparatively small volume of air, and the time interval during which both cooling fans F1 and F2 are driven becomes short whereby the amount of power consumption is reduced and the level of noise on the outside of the automobile is lowered.

These two cooling fans F1 and F2 may be provided for cooling the engine exclusively. However, if the automobile is equipped with an air conditioner, one cooling fan F1 or F2 also may be used in common as a fan for a condenser. FIG. 3 is a circuit diagram showing the second embodiment in which a fan for the air conditioner condenser is used also as a fan for cooling the engine.

In FIG. 3, a typical conventional control circuit of the air conditioner is depicted inside a box of broken line. In this embodiment, a condenser fan motor M1 for driving a fan F1 for the condenser corresponds to the first fan motor M1 of the first embodiment shown in FIG. 1. The first water temperature switch SW1 is connected to a relay coil 1*a* of a fan relay 1 for switching the electric path of the condenser fan motor M1 on and off. The conductor between switch SW1 and relay coil 1*a* is connected to a circuit portion including a pressure switch 2, thermostat 3 and air conditioner switch 4 for control of the operation of the air conditioner. By such a circuit arrangement, the fan motor M1 is energized either when the compressor of the air conditioner is driven or when the temperature of the engine cooling water rises above the set temperature T1 of the first water temperature switch SW1. The compressor of the air conditioner is driven if the compressor magnet clutch 6 is connected by actuation of a clutch relay 5 which is energized when the air conditioner switch 4 is ON, the pressure switch 2 is ON due to a low pressure on the outlet of the compressor, and the thermostat 3 is ON due to a high temperature in the interior of the car.

By the foregoing arrangement of FIG. 3, the condenser fan motor M1 is energized and the cooling air is supplied to the radiator by the fan F1 for the condenser if the temperature of the engine cooling water rises above the set temperature T1 of the first water temperature switch SW1 irrespective of the operation state of the air conditioner, as for example even when the air conditioner switch 4 is OFF. Thus, in the second embodiment, a control circuit C1 for actuating the fan motor M1 depending upon the temperature of the engine still is formed by the first water temperature switch SW1 and fan relay 1.

In addition, in the embodiment of FIG. 3 the electric path of a radiator fan motor M2 for driving a fan F2 for the radiator is connected in parallel across the air conditioner control circuit. This radiator fan motor M2 corresponds to the second fan motor M2 included in the first embodiment of FIG. 1. In the electric path of the radiator fan motor M2, a control circuit C2 including the second water temperature switch SW2 is provided. This second water temperature switch SW2 is set to a predetermined temperature T2 of value higher than the set temperature T1 of the first water temperature switch SW1, as in the case of the first embodiment shown in FIG. 1.

Therefore, a cooling control apparatus for the automobile engine is provided with the same functional effect as that of the first embodiment shown in FIG. 1 while using the fan F1 for the condenser of the air conditioner. While the air conditioner is in operation the cooling power of only fan F1 tends to become inadequate whereby the time interval during which both fan motors M1 and M2 are rotated will become longer.

Figure 4:
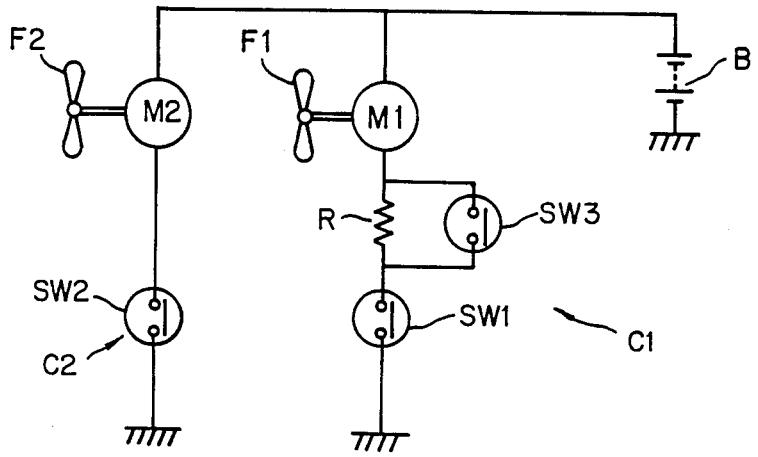
FIGS. 4 and 5 are diagrammatic illustrations of the circuits of third and fourth embodiments of this invention.

Although the rotational frequency of each of the fan motors M1 and M2 in both the first and second embodiments is fixed, it can be made variable and responsive to the engine temperature. FIG. 4 is a circuit diagram showing the third embodiment in which the rotation frequency of the first fan motor M1 is changed in steps in response to the temperature of the engine cooling water.

This third embodiment differs from the first embodiment shown in FIG. 1 in that a parallel circuit including a resistor R and third water temperature switch SW3 is connected between the first fan motor M1 and the first water temperature switch SW1. The predetermined temperature T3 of the third water temperature switch SW3 is set to an intermediate value between the set temperature T1 of the first water temperature switch SW1 and the set temperature T2 of the second water temperature switch SW2. By this different arrangement, when the temperature of the engine cooling water is lower than the set temperature T1 of the first water temperature switch SW1, all the water temperature switches SW1, SW2 and SW3 are open and both the fan motors M1 and M2 are in the stopped or non-operating state. As the engine temperature rises and the cooling water temperature reaches an intermediate temperature between the set temperatures T1 and T3, the first water temperature switch SW1 is closed and the first fan motor M1 is energized. At this time, because the resistor R is interposed between the fan motor M1 and the chassis, a current of comparatively small value flows through the fan motor M1 and the first cooling fan F1 driven by that fan motor M1 is rotated at a comparatively low speed.

As the engine temperature rises further in this third embodiment of FIG. 4 and the cooling water temperature reaches a value at or above the set temperature T3, the third water temperature switch SW3 is closed and the first fan motor M1 is connected directly to the chassis without passing through the resistor R. Accordingly, a large current flows through the fan motor M1, the first cooling fan F1 is rotated at a high speed, and the cooling power is increased. In addition, if the cooling power is inadequate with only one cooling fan F1 and the temperature of the engine cooling water continues to rise and exceeds the set temperature T2, the second water temperature switch SW2 is closed and the second fan motor M2 starts to rotate, whereby the engine and radiator are cooled by both the second cooling fan F2 driven by the motor M2 and the first cooling fan F1 rotating at a high speed.

Figure 5:
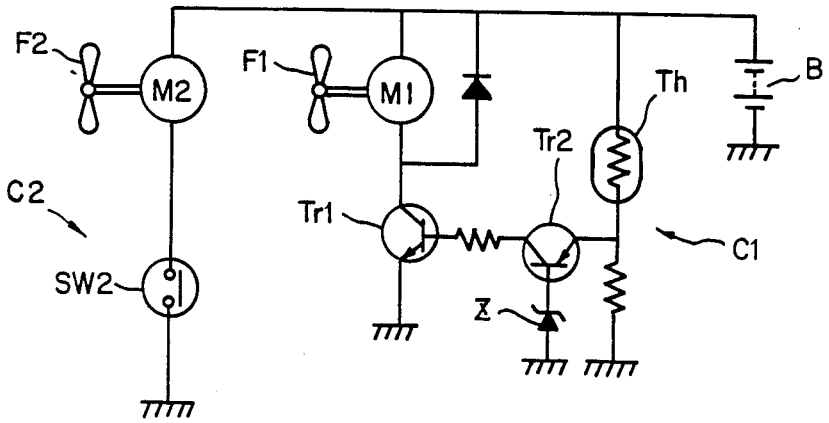

FIG. 5 is a circuit diagram of the fourth embodiment in which the rotation frequency of the first fan motor M1 is changed progressively, rather than being changed in steps in response to the engine temperature, as in the third embodiment of FIG. 4. In this fourth embodiment, the first fan motor M1 is controlled by a control circuit C1 composed of a water temperature thermistor Th, transistors Tr1 and Tr2, and a constant-voltage diode Z. The water temperature thermistor Th has the property of reducing its resistance with an increase in the temperature of the engine cooling water and is mounted in the vicinity of the outlet of the radiator. The second fan motor M2 is controlled by the control circuit C2 including the water temperature switch SW2 in the same manner as previously described. In the control circuit C1, the circuit parameters are selected so that when the temperature of the engine cooling water reaches the comparatively low set temperature T1 a base voltage is applied to the transistor Tr1. In this cooling control arrangement for the engine, when the temperature of the engine cooling water is lower than the set temperature T1, the transistor Tr1 does not turn on and both the fan motors M1 and M2 are in the stopped state. As the cooling water temperature rises above the set temperature T1 and the resistance of the water temperature thermistor Th becomes smaller than a given value, the base voltage is applied to the transistor Tr1, so that this transistor Tr1 turns on and the first fan motor M1 starts to rotate. The more the cooling water temperature increases, the more the resistance of the water temperature thermistor Th decreases, whereby the base voltage of the transistor Tr1 increases and the current flowing through the first fan motor M1 also increases. Accordingly, the higher the temperature of the engine cooling water, the faster the fan motor M1 rotates. As the cooling water temperature reaches the set temperature T2, the water temperature switch SW2 closes and the second fan motor M2 starts to rotate. Thus, when the engine temperature is high, the engine is cooled by both the cooling fans F1 and F2.

Although in all of the foregoing embodiments there are provided two cooling fans F1 and F2 and two fan motors M1 and M2 for driving them, it is possible to provide more than two sets of fans and motors, and to design the circuit so as to achieve a finer control.

Further, although both the cooling fans F1 and F2 supply the cooling air to the radiator for cooling the engine via the cooling water, the system may be designed so that at least one cooling fan F1 or F2 supplies the cooling air to, for example, the external surface of the engine to cool the engine directly. Specifically, in such a case, the engine temperature may be detected by way of the air temperature of the engine compartment or of the surface temperature of the engine, in place of the cooling water temperature.

Furthermore, although in the embodiments shown in FIGS. 4 and 5 the rotation frequency only of fan motor M1 is changed in response to changes in the engine temperature, the rotation frequency of each of the fan motors M1 and M2 may be made variably controllable. With such an arrangement, it is also possible to cause a plurality of cooling fans F1, F2 to rotate simultaneously at a low speed during low cooling requirement circumstances. In addition, it is possible to employ a plurality of cooling fans differing in cooling air moving capacity and operate them individually in accordance with the operation conditions of the automobile.

As will be apparent from the foregoing description, according to the present invention there are provided a plurality of cooling fans and a plurality of fan motors for driving respectively these fans, and the respective fan motors are energized when the engine temperature reaches different predetermined values. Therefore, the volume of cooling air to be supplied is changed in response to the engine temperature, whereby overcooling and/or overheating of the engine is prevented and only an appropriate cooling power is provided. It is possible to rate the blowing capacity of each cooling fan at a comparatively small value with only one cooling fan being driven at any time the engine is under a low load whereby the power consumption and noise can be reduced.

Still further, because it is possible to use the cooling fans in common as ones for the radiator, condenser, and the like of the air conditioner mounted on the automobile, these cooling fans can be utilized effectively.

In addition, by making the rotation frequency of the fan motor changeable in response to the engine temperature, it is possible to reduce the power consumption and noise. Because the power consumption by the cooling fans is lowered in comparison with the prior art, the required capacity of the battery, alternator, and the like can be reduced and the fuel-efficiency can be improved.

The invention claimed is:

1. A cooling control apparatus for the cooling system of an automobile engine, comprising, a plurality of fan motors each having a fan for moving air through the cooling system, a separate control circuit connected to each fan motor, each control circuit being responsive to the cooling system temperature for causing operation of the fan motor, at least one of said control circuits including means responsive to a different cooling system temperature than a cooling system temperature of a remaining control circuit for operating the fan motor connected to said at least one control circuit without operating any other fan motor, and an air conditioning system having a selected said fan motor operable for providing cooling for the air conditioning system, the control circuit connected to said selected fan motor including switch means for causing operation of said selected fan motor when cooling is required for the air conditioning system regardless of the cooling system temperature.

2. The cooling control apparatus of claim 1 wherein first and second fan motors and control circuits are provided with the first control circuit responsive to a cooling system temperature at an engine inlet of approximately 90° C. and the second control circuit responsive to a cooling system temperature of approximately 100° C.

3. The cooling control apparatus of claim 1 wherein first and second control circuits are responsive to cooling system temperatures of approximately 10° C. difference.

4. The cooling control apparatus of claim 1 wherein said at least one control circuit is responsive to a predetermined cooling system temperature lower than any remaining control circuit and said predetermined cooling system temperature is approximately a desired temperature for engine operation.

5. The cooling control apparatus of claim 1 wherein one said control circuit includes means for causing operation of only the fan motor connected thereto at two different speeds at and above two different predetermined cooling system temperatures.

6. The cooling control apparatus of claim 1 wherein one said control system includes means for causing variable speed operation of the fan motor connected thereto in response to variations in the cooling system temperature.

7. The cooling control apparatus of claim 6 wherein said means for causing variable speed operation includes a thermistor having a resistance variable inversely with the cooling system temperature.

8. The cooling control apparatus of claim 1 wherein a control circuit is responsive to an engine temperature for operating the fan motor connected thereto to cause the flow of air over the engine for cooling.

9. A cooling control system for an automobile engine, comprising, a plurality of fan means selectively operable for cooling the engine, and a temperature responsive means separately connected to each fan means for selectively operating each of fan means, all of said temperature responsive means at substantially the same location, one of said temperature responsive means causing operation of the connected fan means at a temperature of the cooling system different from any other temperature responsive means causing selective operation of another of said plurality of fan means, an air conditioning system which is cooled by a selected one of said plurality of fan means, and means for causing operation of said selected one of said plurality of fans when cooling of the air conditioning system is required without regard for cooling system temperature.

10. The cooling control system of claim 9 wherein said temperature responsive means causes said one fan means to operate at and above a first predetermined cooling system temperature lower than a second predetermined cooling system temperature at which said temperature responsive means causes operation of said another of said plurality of fan means.

11. The cooling control system of claim 10 wherein the first and second predetermined engine temperatures are temperatures of cooling water entering the engine.

12. The cooling control system of claim 11 wherein said first predetermined engine temperature is approximately 90° C. of the engine cooling water and said second predetermine engine temperature is approximately 100° C.

13. The cooling control system of claim 9 wherein said temperature responsive means includes means for causing said one fan means to operate to in a manner to vary the rate of cooling air moved by that one fan means in response to the cooling system temperature.

14. The cooling control system of claim 13 wherein said one fan means is operated at two different speeds for causing the varying rate of cooling air moved.

15. The cooling control system of claim 14 wherein said one fan means is operated at a variable rate of speed in relation to the cooling system temperature for causing the varying rate of cooling air moved.

16. The cooling control system of claim 9 wherein said temperature responsive means also causes operation of said selected one of said plurality of fan means at and above a predetermined cooling system temperature.

* * * * *